United States Patent [19]

Fischer et al.

[11] 4,153,833

[45] May 8, 1979

[54] ELECTRIC HOT PLATE ASSEMBLY WITH A TEMPERATURE LIMITER

[75] Inventors: Karl Fischer, Am Gaensberg 8, 7519 Oberderdingen, Fed. Rep. of Germany; Klaus Barth, Bretten-Goelshausen, Fed. Rep. of Germany

[73] Assignee: Karl Fischer, Fed. Rep. of Germany

[21] Appl. No.: 930,636

[22] Filed: Aug. 3, 1978

Related U.S. Application Data

[63] Continuation-in-part of Ser. No. 794,207, May 5, 1977, Pat. No. 4,122,330.

[30] Foreign Application Priority Data

Aug. 5, 1977 [DE] Fed. Rep. of Germany ..... 2735426

[51] Int. Cl.[2] ..... H05B 3/68

[52] U.S. Cl. ..... 219/449; 219/452; 219/512; 337/354

[58] Field of Search ..... 219/448, 449, 450, 452, 219/456, 458, 462, 489, 510, 512; 337/354, 386

[56] References Cited

U.S. PATENT DOCUMENTS

| | | | |
|---|---|---|---|
| 2,196,671 | 4/1940 | Gille et al. | 337/354 X |
| 2,306,979 | 12/1942 | Potsdam | 219/449 |
| 2,311,087 | 2/1943 | Sandell | 219/449 |
| 2,427,944 | 9/1947 | Clark | 337/354 |
| 2,644,874 | 7/1953 | Miller | 219/449 X |
| 2,684,430 | 7/1954 | Bieling | 219/449 |
| 2,691,717 | 10/1954 | Huck | 219/462 |
| 2,813,963 | 11/1957 | Lennox | 219/449 |
| 2,816,203 | 12/1957 | Weeks | 219/489 |
| 3,591,960 | 7/1971 | Paine et al. | 337/354 X |
| 4,045,654 | 8/1977 | Eide | 219/449 |

FOREIGN PATENT DOCUMENTS

| | | | |
|---|---|---|---|
| 1104087 | 4/1961 | Fed. Rep. of Germany | 219/449 |
| 1615258 | 4/1973 | Fed. Rep. of Germany | 219/449 |
| 2343834 | 4/1975 | Fed. Rep. of Germany | 219/449 |
| 2515905 | 10/1976 | Fed. Rep. of Germany | 219/449 |
| 213621 | 3/1924 | United Kingdom | 337/354 |

*Primary Examiner*—Volodymyr Y. Mayewsky
*Attorney, Agent, or Firm*—Steele, Gould & Fried

[57] ABSTRACT

An electric hot plate assembly including an electrically heated hot plate having at least one electrical conductor disposed therewithin for heating an annular zone of the plate when energized, cover means defining an enclosed space located immediately beneath said hot plate and secured thereto, and a device for limiting the operating temperature of the hot plate, the temperature limiting device comprising a housing, a bimetallic element projecting from said housing into said enclosed space at a location beneath said annular zone, the housing having a base portion disposed externally of said enclosed space, connecting terminals located in the base portion of the housing for connecting said at least one hot plate conductor to an electrical supply, and switch means located in said base portion of the housing and adapted to be actuated by the bimetallic element by a pressure rod means, said bimetallic element being curved, the first end of said bimetallic element being in pressure engagement with said pressure rod means acting on said switch means, the second end of said bimetallic element being fixedly mounted adjacent a passage for said pressure rod means into said base portion.

5 Claims, 2 Drawing Figures

ELECTRIC HOT PLATE ASSEMBLY WITH A TEMPERATURE LIMITER

CROSS REFERENCES

The subject application is a continuation-in-part of United States Patent Application Ser. No. 794,207, filed May 5, 1977, now U.S. Pat. No. 4,122,330.

BACKGROUND OF THE INVENTION

U.S. Application Ser. No. 794207 relates to a temperature limiter for an electric hot plate assembly having a bimetallic expansion element arranged in an enclosed space closed by a cover and located directly beneath the underside of the heated annular zone of the electric hot plate assembly and having a switch actuated by the expansion element and located on a base carrying the terminals of the electric hot plate assembly.

According to U.S. application Ser. No. 794207 the bimetallic expansion element is provided in a portion preassembled together with the base, which projects from the temperature limiter base arranged outside the enclosed space and thermally insulated relative thereto.

U.S. Application Ser. No. 794207 provides a temperature limiter for an electric hot plate assembly which carries the terminals of said assembly and with its terminal and switch part is arranged completely outside the enclosed space separated by the cover plate. In spite of this the projecting portion can be coupled from the heating standpoint particularly closely to the heating system of the electric hot plate assembly, without a direct contact with the underside of the hot plate being necessary. In U.S. application Ser. No. 794207 the projecting portion comprises a sheet metal yoke in the inside of which is provided a bimetallic element supported on either side and which by means of an adjusting screw screwed into the centre thereof acts on a thrust rod which actuates the switch of the temperature limiter.

BRIEF SUMMARY OF THE INVENTION

The problem of the present invention is to further improve the temperature limiter according to U.S. Application Ser. No. 794207 so as to further simplify manufacture, whilst providing ease of assembly and adjustability.

According to the present invention this problem is solved in that the bimetallic expansion element is curved, has at one end a pressure point for the thrust rod acting on the switch and with its other end is fixed in the vicinity of the passage of the thrust rod into the base.

Thus, according to the present invention the bimetallic expansion element is self-supporting and can be fixed to the base without additional retaining and supporting yokes. The bimetallic element can be constructed in a relatively sturdy manner and due to its large effective length resulting from the curved shape can provide adequate forces and an adequate expansion path. Furthermore the problem of the above-mentioned Application is further developed so as to provide a direct heat coupling of the bimetallic expansion element with the heating system of the electric hot plate assembly without a direct physical engagement of the temperature sensor with this heating system being necessary. In the present invention there is no longer an element which could protect this sensor, i.e. the bimetallic expansion element from the hot plate heating system.

According to the a preferred embodiment the thrust rod can pass through an opening in the bimetallic expansion element in the vicinity of its attachment. The bimetallic expansion element is preferably a bimetallic strip bent by 180°. These measures ensure an absolute symmetry of the pressure conditions. Thus, the thrust rod really forms the chord of an arc. A setscrew with a guide for the thrust rod can be provided at the pressure point. It is preferably a calotte on the underside of the setscrew in which the thrust rod is guided. It should also be noted that as a result of the curved bimetallic element there is no need to fix the thrust rod and the element by means of a spring, because they can be directly fixed to the base. The bimetallic expansion element can preferably be fixed in a trough-like, upwardly open sealing part. This trough-like part, which was also provided in the above-mentioned Application when however the bimetallic element was not directly fixed to it, seals the opening in the hot plate cover necessary for introducing the projection portion into the enclosed space of said hot plate and thus forms a shield for the temperature limiter base with respect to the heat from the electric hot plate assembly.

BRIEF DESCRIPTION OF THE DRAWINGS

The invention is described in greater detail hereinafter relative to a preferred, but non-limitative embodiment of the invention and with reference to the attached drawings, wherein show.

DETAILED DESCRIPTION OF THE PREFERRED EMBODIMENTS

Figure 1:
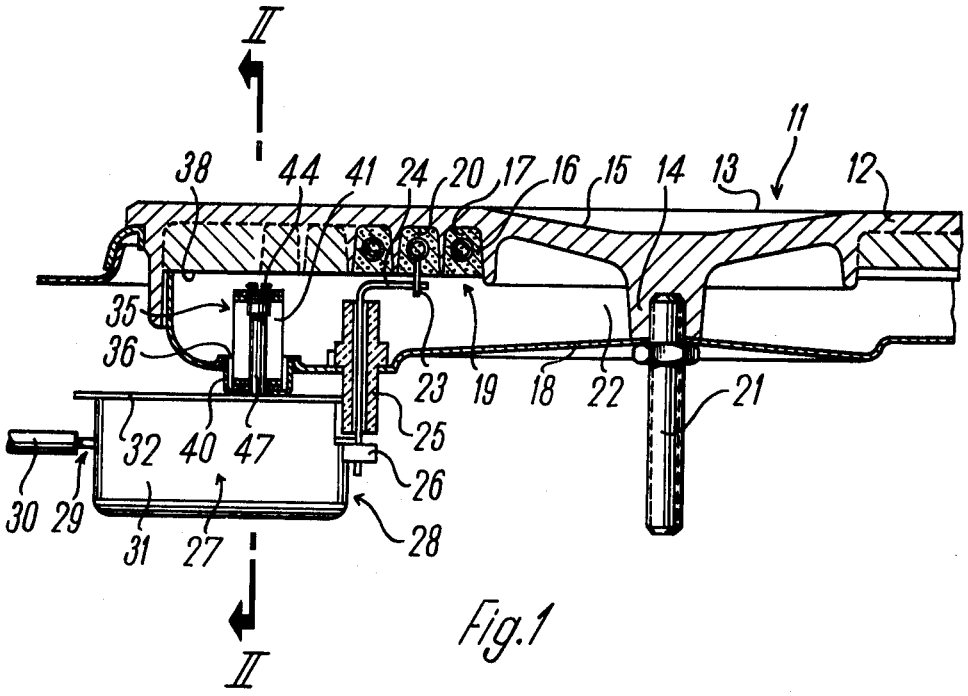
FIG. 1 a vertical section through part of an electric hot plate assembly with a temperature limiter.

The drawings show an electric hot plate assembly 11, which comprises a hot plate body 12 of cast material, having a flat upper cooking surface 13 and a relatively depressed unheated central zone 15, in whose underside is cast a threaded socket 14. The cooking surface zone, that is the annular heating zone 19 surrounding the unheated central zone 15 is heated by means of spiral heating conductors 16, which are received in an embedding material 17 in spiral grooves 20 on the underside of the hot plate body 12. The underside of the heating zone is covered by a cover 18, made from pressed sheet metal, which is retained by means of a central pin 21 screwed into the threaded socket 14. Thus, a hot interior space 22 is formed between cover 18 and the underside of the hot plate.

Current is supplied to the heating conductors 16 by means of L-shaped pins 23, which project out of the embedding material 17 and are welded to connecting wires 24. The latter pass outwards through openings in an insulating grommet 25, located in an opening of cover 18 and are then welded to the ends 26 of supply leads in the form of flat connecting strips.

The base 27 of a temperature limiter 28 is located at a distance below cover 18. It has an elongated rectangular shape, whose longitudinal extension runs radially with respect to the hot plate. The base projects laterally above the edge of the hot plate and carries on its outwardly directed side the electrical terminals 29 of the electric hot plate assembly and into which are plugged the supply lines 30 from the mains, or from a switching or controlling device.

Figure 2:
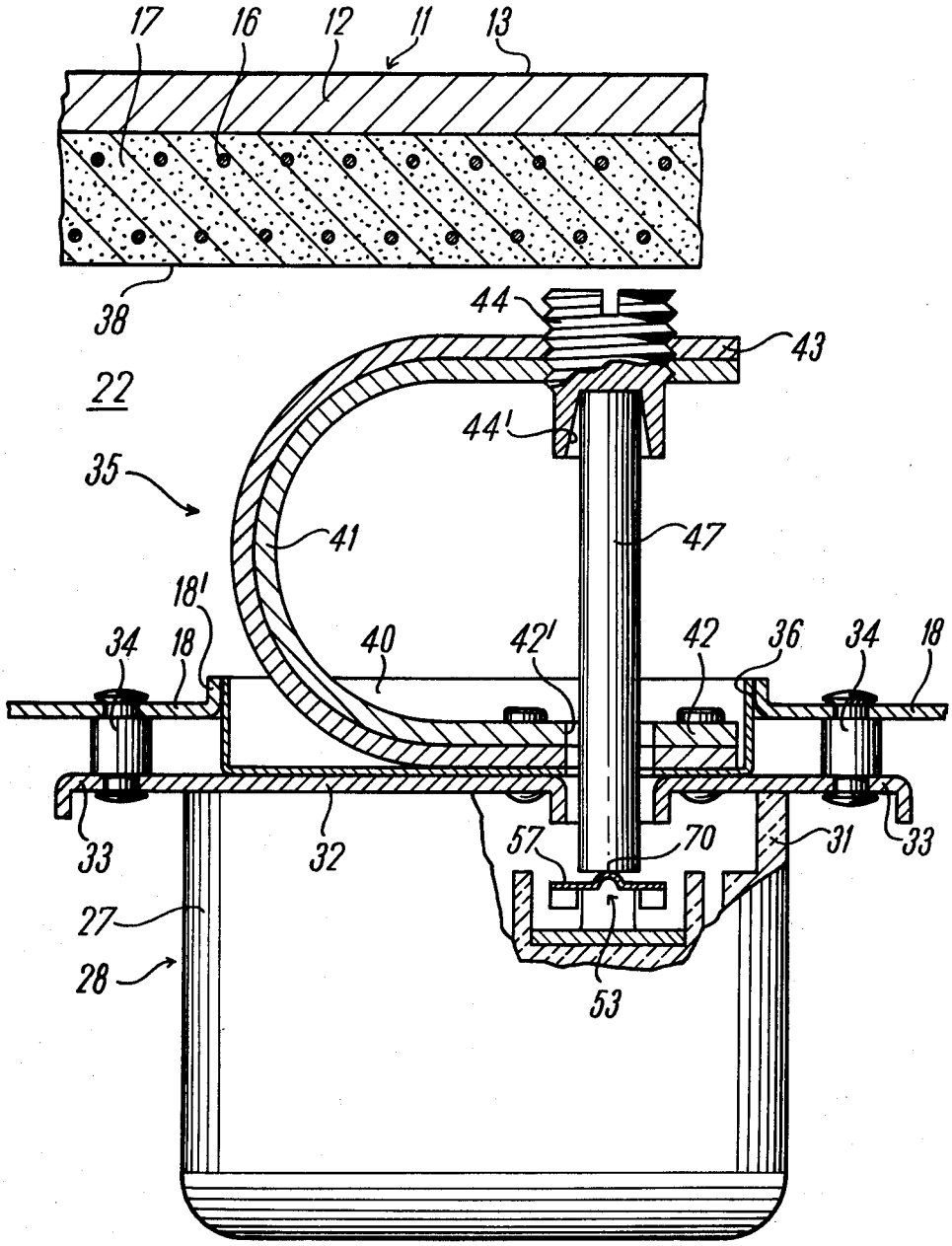
FIG. 2 a part sectional representation along the line II—II of FIG. 1.

The base 27 of the temperature limiter 28 comprises a ceramic insulating member 31 and a sheet metal plate 32, which faces towards cover 18 and to which is attached insulating member 31. As can be gathered from FIG. 2 metal plate 32 has two lateral eyes 33, through which extend rivets 34 and secure the temperature limiter 28 to cover 18. The distance between the cover and the base ensures a thermal insulation between the same.

The temperature limiter 28 has a portion 35 which extends upwards from the base member and which according to the invention comprises a curved bimetallic expansion element 41. The latter, very sturdily constructed bimetallic element describes a complete 180° arc with in each case two essentially planar ends, so that its overall shape resembles a wide U with a round middle portion. One end 42 of element 41 is located within a trough-like sealing member 40 and together with the latter is fixed to the metal plate 32 (e.g. by means of rivets).

The other end 43 of the bimetallic element has a screw opening into which is screwed the adjusting screw 44. The adjusting screw, which can be adjusted from the top, carries at its lower end a recess or calotte 44', in which is located the upper end of a thrust rod 47, made from ceramic material, which passes through an opening 42' in the fixed end 42 of the bimetallic element, as well as through corresponding openings in sealing member 40 and metal plate 32 and projects into the inside of base member 31. The lower end of thrust rod 47 there acts on the pressure point 70 of a snap spring 57 of a snap switch 53.

The upper edge of the trough-like member 40 engages on the bush-like boundary 18' of opening 36 in cover 18 through which the projecting portion 35 of temperature limiter 28 is introduced into the hot interior space 22 and seals the latter with respect to the outside and in particular switch base 27. It can be seen that the bimetallic element mainly extends in the circumferential or chord direction with respect to the hot plate.

The temperature limiter co-operates with the electric hot plate assembly in the following manner:

With switch 53 closed in the normal manner the temperature of the bimetallic expansion element 41 follows in a completely satisfactory manner the heating of the electric hot plate assembly, because element 41 over a considerable part of its length runs parallel to the underside 38 of annular heating zone 19 and is otherwise arranged in the hot interior space 22. Due to the omission of any shielding or masses which create thermal inertia, there is an extremely small delay in the heating time of the bimetallic expansion element 41 compared with that of the hot plate. However, due to the mechanical and thermal sealing base 27 remains relatively cool.

On heating bimetallic element 41 the latter bends in the sense of closing the U, so that a pressure is exerted on thrust rod 47 which, at a temperature preset by means of adjusting screw 44, switches switch 53. As a result all or at least a large part of the heating power of the electric hot plate assembly is switched off and the temperature of the latter and in particular that of the heating system drops. Here again this can be relatively rapidly followed by the bimetallic element and when using a snap switch, which has a contact travel of only a few hundredths of a millimeter and a very low switching hysteresis, reconnection also takes place relatively rapidly. Thus, to a certain extent the temperature limiter functions to some extent like a fixedset regulator which maintains a constant temperature. This is by no means obvious in the case of temperature limiters. Temperature limiters with considerable elasticity and a large switching hysteresis, which are less well coupled to the heating system have a large time-dependence, so that they would only switch on again a relatively long time after switching off the heating system.

The extremely simple and robust construction of the projecting portion 35, which mainly comprises the relatively wide, thick and curved bimetallic element 41 leads to a large expansion path with a relatively large switching force. Despite its considerable length the bimetallic element is concentrated in a relatively small space due to its curved configuration and requires only a relatively small passage opening 36. As in U.S. Application Ser. No. 794207 the temperature limiter is a completely preassemblable and finally adjustable part, which during the manufacture of the hot plate can be supplied to the production line, where it can be connected to the hot plate by rivets 34 without any setting being necessary. Due to its connection with the hot plate terminals not only are the conduction paths kept small, but the necessity of fitting a further part, besides the necessary connection, is obviated.

The invention is not limited to the embodiments described and represented hereinbefore and various modifications can be made thereto without passing beyond the scope of the invention.

What is claimed is:

1. An electric hot plate assembly including an electrically heated hot plate having at least one electrical conductor disposed therewithin for heating an annular zone of the plate when energised, cover means defining an enclosed space located immediately beneath said hot plate and secured thereto, and a device for limiting the operating temperature of the hot plate, the temperature limiting device comprising an electrically non-conductive housing, a bimetallic element projecting from said housing into said enclosed space at a location beneath said annular zone, the housing having a base portion disposed externally of said enclosed space, connecting terminals located in the base portion of the housing for connecting said at least one hot plate conductor to an electrical supply, and switch means located in said base portion of the housing and adapted to be actuated by the bimetallic element by an electrically non-conductive pressure rod means, said bimetallic element being curved, the first end of said bimetallic element being in pressure engagement with said pressure rod means acting on said switch means, the second end of said bimetallic element being fixedly mounted adjacent a passage for said pressure rod means into said base portion.

2. An electric hot plate assembly according to claim 1, wherein said bimetallic element has an opening in the area of its attachment to the base portion through which said pressure rod means projects.

3. an electric hot plate assembly according to claim 1, wherein in the said first end of said bimetallic element adjusting screw means are provided having guide means for said pressure rod means.

4. An electric hot plate assembly according to claim 1, wherein said bimetallic element is a bimetallic strip bent by approximately 180°.

5. An electric hot plate assembly according to claim 1, wherein said bimetallic element is fixed in the area of a troughlike upwardly open sealing member.

* * * * *